US010207151B2

(12) United States Patent
Truesdell et al.

(10) Patent No.: US 10,207,151 B2
(45) Date of Patent: Feb. 19, 2019

(54) POLE CLIMBING FALL RESTRICTION ASSEMBLY

(71) Applicant: Buckingham Manufacturing Company, Inc., Binghamton, NY (US)

(72) Inventors: Kevin W. Truesdell, Binghamton, NY (US); James J. Rullo, Binghamton, NY (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 0 days.

(21) Appl. No.: 15/137,155

(22) Filed: Apr. 25, 2016

(65) Prior Publication Data

US 2016/0310794 A1 Oct. 27, 2016

Related U.S. Application Data

(60) Provisional application No. 62/152,103, filed on Apr. 24, 2015.

(51) Int. Cl.
*A63B 27/00* (2006.01)
*A62B 35/00* (2006.01)

(52) U.S. Cl.
CPC ..... *A63B 27/00* (2013.01); *A62B 35/0068* (2013.01)

(58) Field of Classification Search
CPC ..... A63B 27/00
See application file for complete search history.

(56) References Cited

U.S. PATENT DOCUMENTS 2,920,714 A * 1/1960 Johnson ..... A63B 27/00 182/9
3,840,091 A * 10/1974 Conlon ..... A62B 35/0068 182/9
5,038,719 A * 8/1991 McDonough ..... A01K 27/00 119/772
5,649,504 A * 7/1997 Culp ..... A01K 27/003 119/795
5,718,189 A * 2/1998 Blake ..... A01K 27/00 119/770
6,637,077 B2 * 10/2003 Doty ..... B60P 3/079 24/298
6,851,393 B2 * 2/2005 Bremm ..... A01K 27/003 119/770
2010/0051382 A1 * 3/2010 Schlief ..... A62B 35/0006 182/9
2010/0078261 A1 * 4/2010 Watts ..... A62B 35/00 182/9

(Continued)

OTHER PUBLICATIONS

Exam report from Canadian Intellectual Property Office pp. 1-4; Application No. 2,928,079 Buckingham Manufacturing Company, Inc. Pole Climbing Fall Restriction Assembly.

*Primary Examiner* — Alvin C Chin-Shue
(74) *Attorney, Agent, or Firm* — Bond Schoeneck & King, PLLC; George McGuire; Frederick Price

(57) ABSTRACT

A fall restriction assembly for use by a pole climber/the assembly includes an elongated outer strap having first and second opposite ends, an inner strap/lanyard adjustably connected to the outer strap and that includes a connector for interconnecting it to a body belt worn by the pole climber; an adjustable connector assembly interconnecting the inner strap/lanyard to the outer strap; and a looped handle connected to the first end of the outer strap.

2 Claims, 5 Drawing Sheets

(56) References Cited

U.S. PATENT DOCUMENTS

| | | | | |
|---|---|---|---|---|
| 2011/0214941 | A1* | 9/2011 | Petty | A63B 27/00 182/9 |
| 2011/0290586 | A1* | 12/2011 | Goldmann, II | A63B 27/00 182/3 |
| 2013/0126269 | A1* | 5/2013 | Perner | A63B 27/02 182/9 |
| 2016/0213961 | A1* | 7/2016 | Anderson | A62B 35/0075 |

* cited by examiner

POLE CLIMBING FALL RESTRICTION ASSEMBLY

REFERENCE TO RELATED APPLICATION

The present application relates and claims priority to United States Provisional Application Ser. No. 62/152,103, filed Apr. 24, 2015, the entirety of which is hereby incorporated by reference.

BACKGROUND

1. Field of Invention

The present invention relates generally to pole climbing equipment, and more particular to assemblies that assist in preventing a person from falling while ascending or descending a pole.

2. Background of Art

Pole fall restriction assemblies are well known in the art. The assemblies typically comprise an outer strap adapted to wrap around the pole, an inner strap or lanyard that connects to both the outer strap and the user's body belt/harness. The unit wraps around the front of the pole nearest the user, with the adjustment hardware adjusting the effective length of the outer and inner strap/lanyard. When a user begins ascending or descending a pole, he or she will grab a hold of the strap near ones end, while making any necessary adjustments to the effective length of the straps with the other hand. When actually ascending or descending, the user will hold the ends of the straps and move them up or down while hitchhiking up or down the pole.

While grabbing a hold of one end of the outer strap is common when ascending and descending, not all fall restriction assemblies are comfortably structured to permit the grab. Many include a length of strap that provides sufficient material on which to grab, while others have the connection hardware, typically a large D-ring, in the vicinity of where a grab would be located, thereby interfering with a comfortable grip.

3. Objects and Advantages

It is a primary object and advantage of the present invention to provide a handle on the outer strap onto which a user can comfortably grab hold when ascending or descending a pole.

Other objects and advantages of the present invention will in part be obvious and in part appear hereinafter.

SUMMARY OF THE INVENTION

In accordance with the foregoing objects and advantages, the present invention provides a pole fall restriction assembly that includes improved structure for facilitating a user grabbing the assembly. The fall restriction assembly comprises an outer strap, inner strap or lanyard and a looped handle that attaches to or is integrally formed adjacent an end of the outer strap and is adapted to comfortably receive a user's hand there through.

More particularly, in one aspect, a fall restriction assembly for use by a pole climber is provided. The assembly includes an elongated outer strap having first and second opposite ends, an inner strap or lanyard adjustably connected to the outer strap and that includes a connector for interconnecting it to a body belt/harness worn by the pole climber; an adjustable connector assembly interconnecting the inner strap or lanyard to the outer strap; and a looped handle connected to the first end of the outer strap.

In another aspect, the handle is positioned rearward of the outer strap's first end (away from the outer strap's second end).

BRIEF DESCRIPTION OF THE DRAWINGS

The present invention will be more fully understood and appreciated by reading the following detailed Description in conjunction with the accompanying drawings, in which.

DETAILED DESCRIPTION

Figure 1:
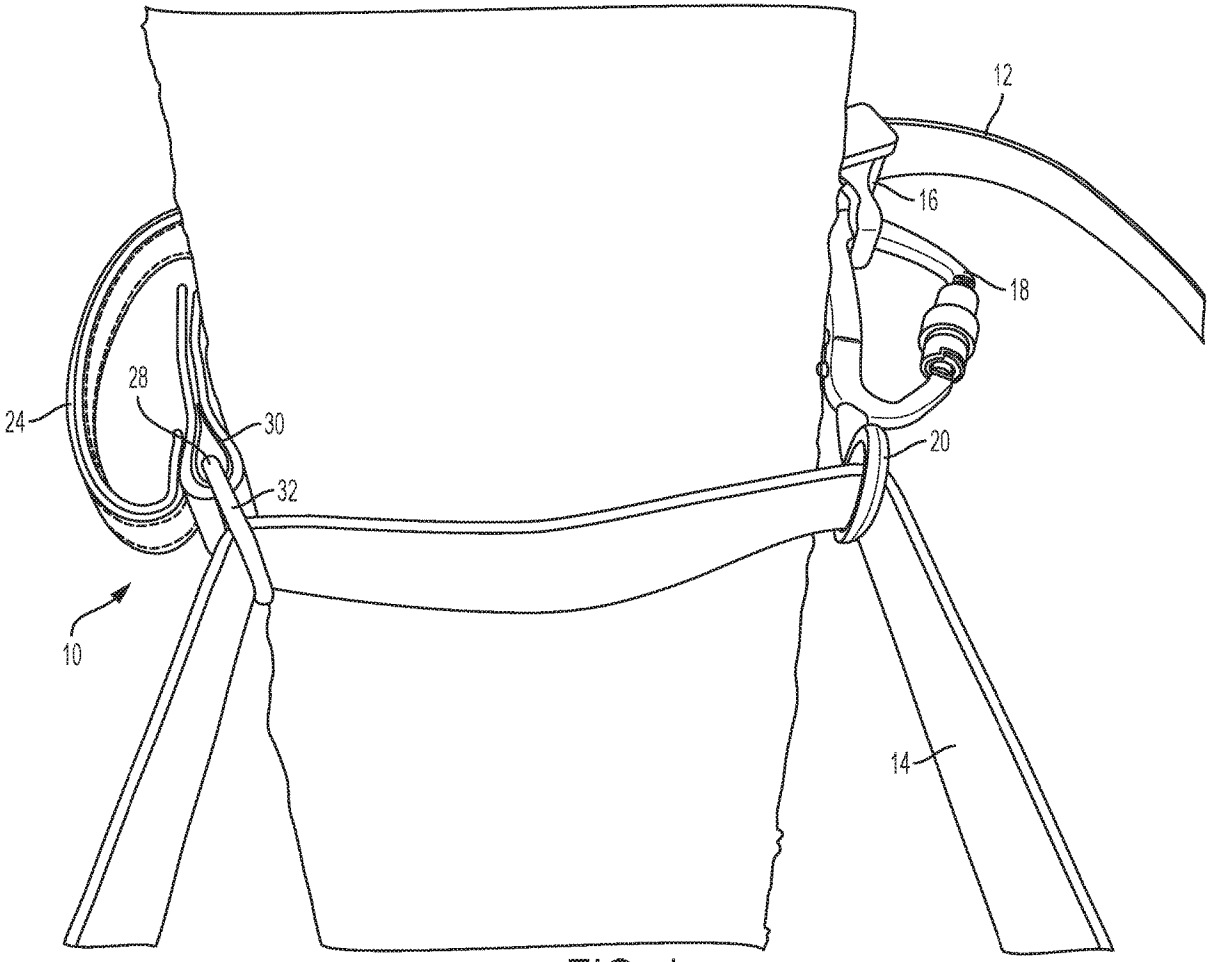
FIG. 1 is a perspective view of an embodiment of the present invention shown in use on a pole.

Referring now to the drawings, in which like reference numerals refer to like parts throughout, there is seen in FIG. 1 a pole fall restriction assembly, designated generally by reference numeral 10, comprising an outer strap 12, an inner strap/lanyard 14 adjustably interconnected to outer strap 12 by a cam buckle 16 and connector 18 (e.g., a D-shaped carabineer) and a D-ring 20, and adjustable connector assembly 22 for interconnecting inner strap/lanyard 14 to a climber's body belt (not shown). Through the use of pole fall restriction assembly 10, a worker climbing a pole will be tethered and supported relative to the pole as s/he ascends and descends the pole.

When a climber reaches a desired position on a pole, s/he may adjust assembly 10 so that it is properly and safely positioned and maintained around the pole and worker. To make the adjustments to assembly 10, a worker may comfortably grab hold of outer strap 12 with one hand, while adjusting connector assembly 22 with the other. To facilitate a comfortable grip of outer strap 12, assembly 10 comprises a looped handle 24 formed adjacent end 26 of outer strap 12. Handle 24 is formed by looping and integrating a strip of material into outer strap 12. More specifically, outer strap 12 includes its one end folded back onto itself to form a small channel 28 at the distal end thereof in which a rigid connecting loop 30 is securely positioned. A D-ring 32 or other connector is attached to connecting loop 30. Handle 24 is fastened to the exterior of outer pole strap 12 exteriorly adjacent channel 28 using rivets or other suitable fasteners. By supplying a strip of material from which handle 24 is formed that is separate from the strip of material from which outer strap 12 is formed, and by positioning it at the end of the strap, both the structural integrity and ergonomics of the assembly 10 are enhanced as compared to forming a handle from the same strip of material from which the strap is composed and positioning the handle at some distance interiorly from the end.

Figure 2:
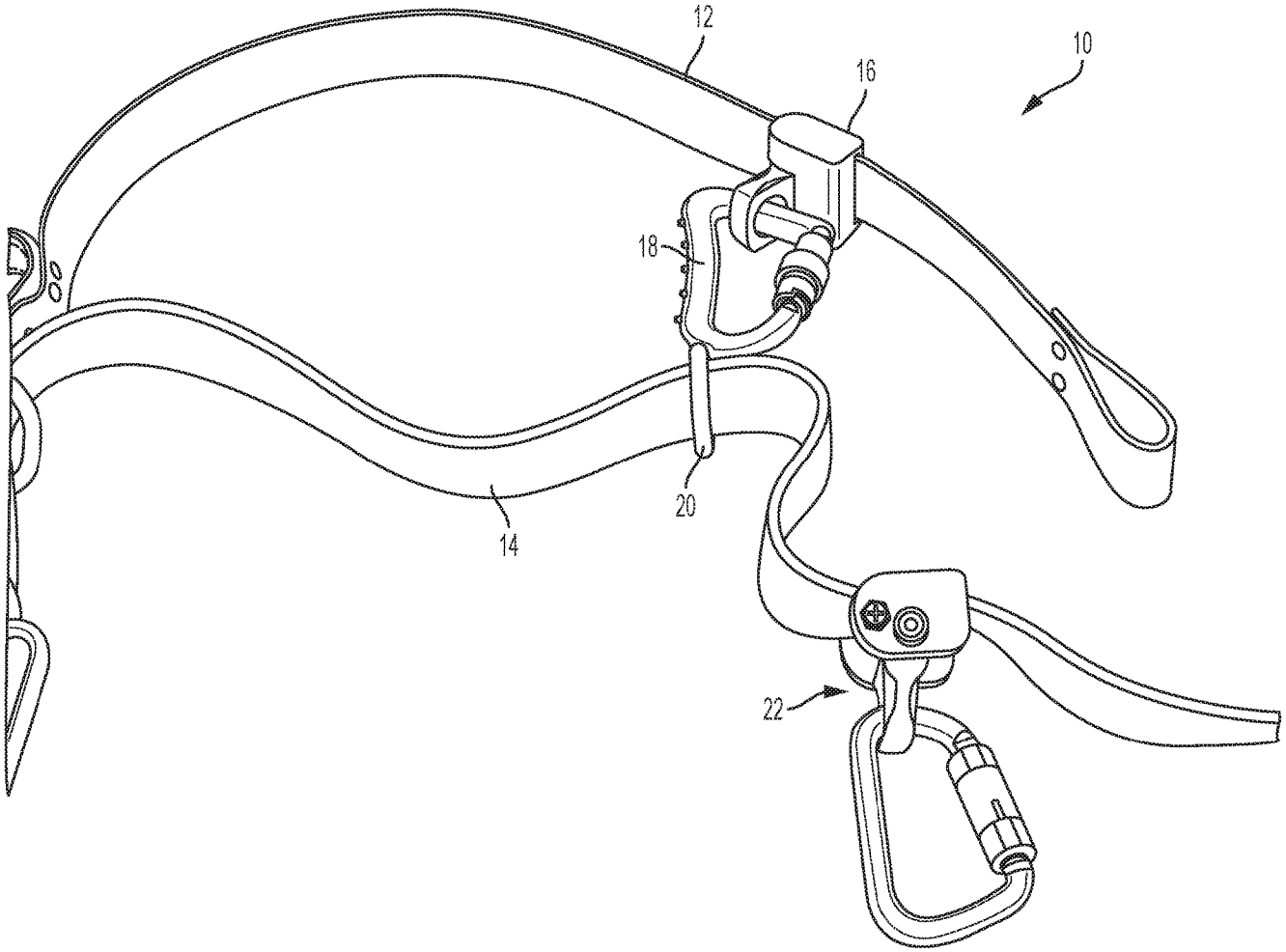
FIG. 2 is a perspective view of an embodiment of the present invention.
Figure 3:
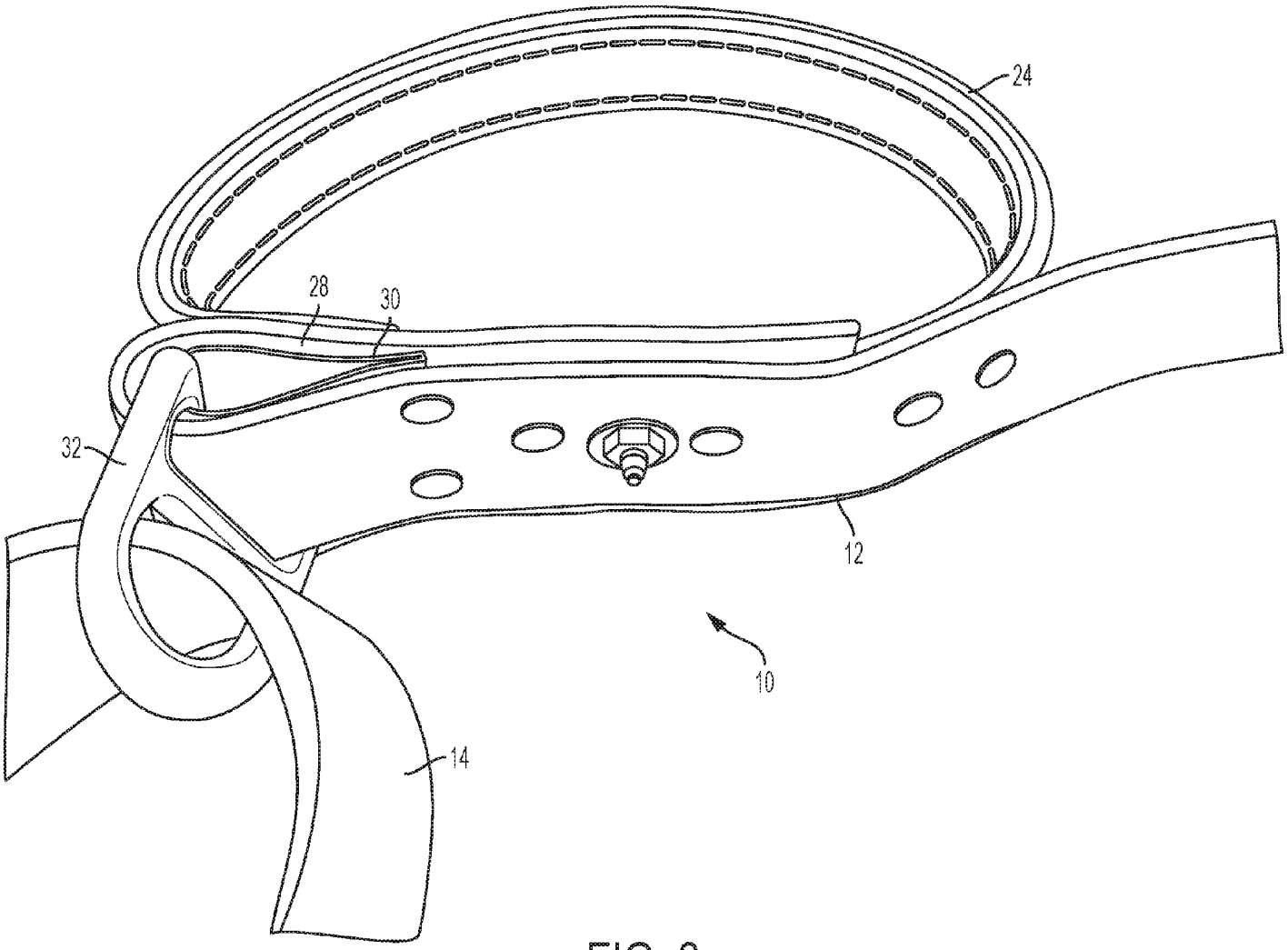
FIG. 3 is an enlarged perspective of an embodiment of the looped handle.
Figure 4:
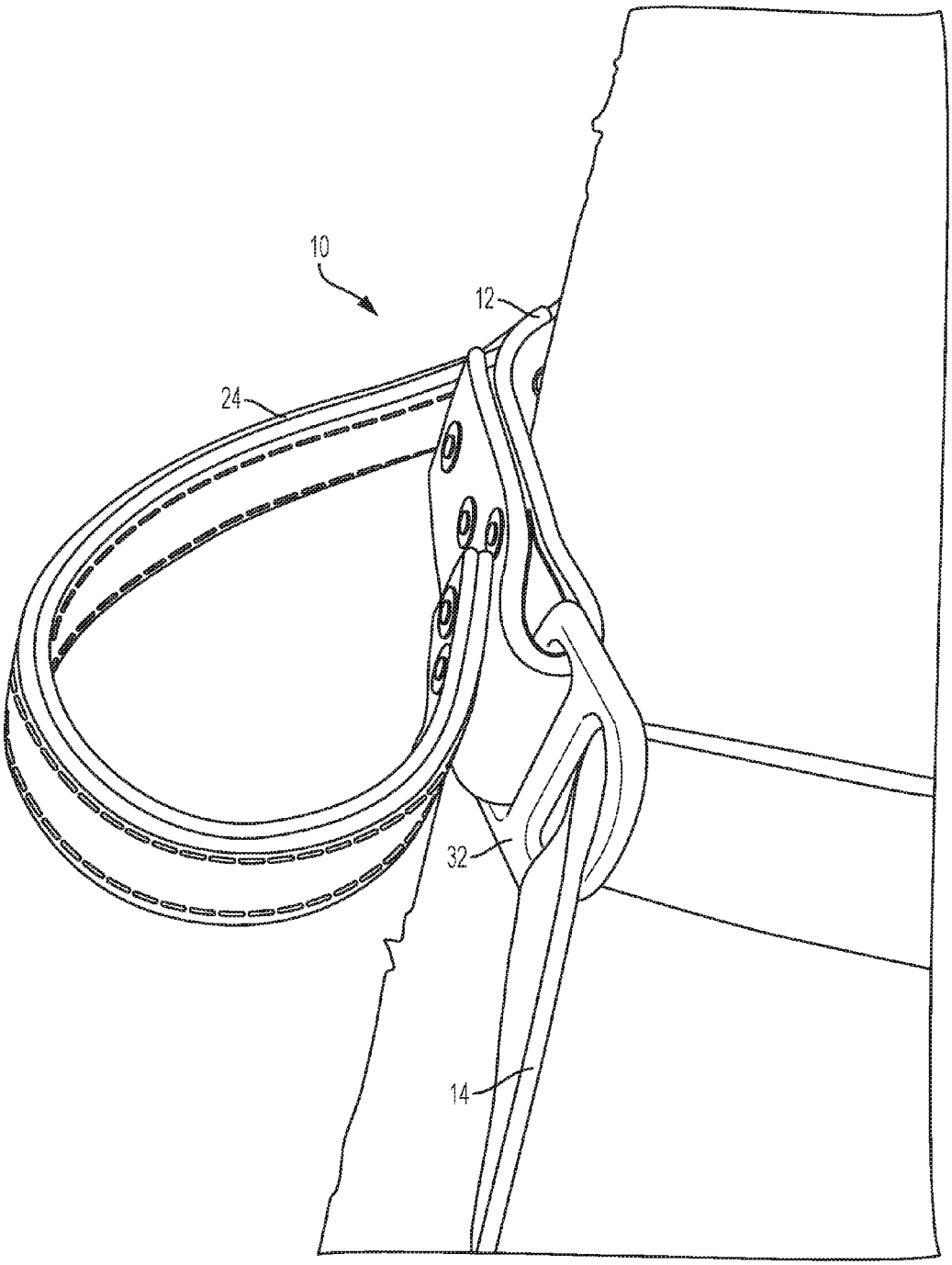
FIG. 4 is a perspective view of an alternate embodiment of the present invention shown in use on a pole.
Figure 5:
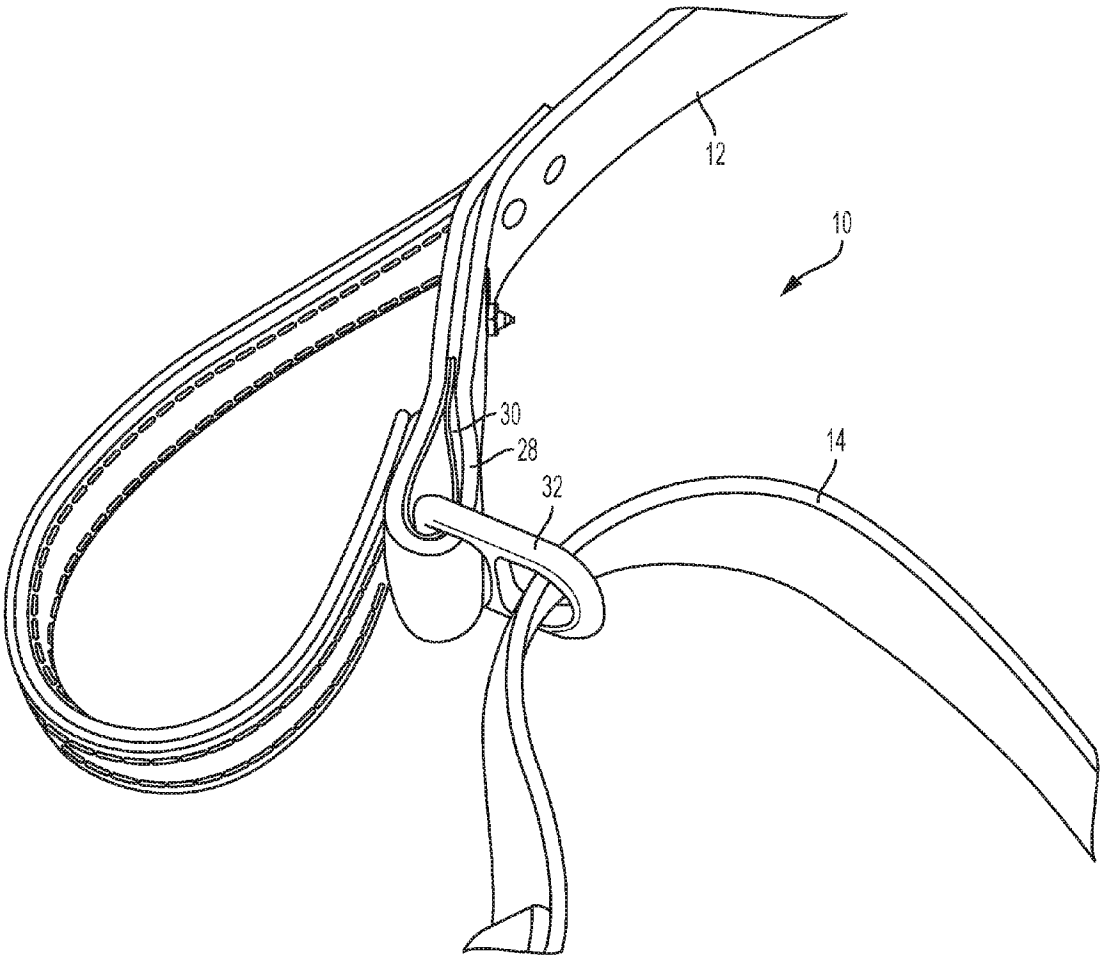
FIG. 5 is an enlarged perspective of an embodiment of the looped handle.

With reference to FIGS. 4 and 5, an alternate embodiment of assembly 10 is shown, wherein looped handle 24 is moved rearward/away from outer strap 12 in comparison to the embodiment of FIGS. 1-3. To provide an option for hand position, in FIG. 3 the handle is centered over the cleat and in FIG. 4 the handle is centered over the D-ring. Each option allows for a different leverage point for different climbing styles.

What is claimed is:

1. A fall restriction assembly for use by a pole climber, comprising:

an elongated outer strap having first and second opposite ends;

a first loop at said first end of said elongated outer strap, said first loop at least partially comprised of said elongated outer strap;

a second loop at said second end of said elongated outer strap, said second loop at least partially comprised of said elongated outer strap;

an inner strap/lanyard adjustably connected to said first loop of said outer strap and comprising a connector for interconnecting to an outer climber;

an adjustable connector assembly interconnecting said inner strap/lanyard at a position distal to said second loop to said outer strap; and a looped handle connected to and positioned co-extensively with said first loop at said first end of said outer strap, wherein said looped handle is a separate strip of material that has a looped handle first end fastened exteriorly over and contacting said first loop of said first end of said outer strap and a looped handle second end extending over said first end of said outer strap, said looped handle second end fastened to a portion of said outer strap positioned proximally to the first loop.

2. A fall restriction assembly for use by a pole climber, comprising:

an elongated outer strap having first and second opposite ends;

a first loop at said first end of said elongated outer strap, said first loop at least partially comprised of said elongated outer strap;

a second loop at said second end of said elongated outer strap, said second loop at least partially comprised of said elongated outer strap;

an inner strap/lanyard adjustably connected to said first loop of said outer strap and comprising a connector for interconnecting to the outer climber;

an adjustable connector assembly interconnecting said inner strap/lanyard at a position distal to said second loop to said outer strap; and a looped handle connected to and positioned linearly outwardly from said first loop at said first end of said outer strap, wherein said looped handle is a separate strip of material that has a looped handle first end fastened exteriorly over and contacting said first loop of said first end of said outer strap and a looped handle second end extending over said first end of said outer strap, said looped handle second end fastened to a portion of said outer strap positioned proximally to the first loop.

* * * * *